US006698621B2

(12) United States Patent
Landers et al.

(10) Patent No.: US 6,698,621 B2
(45) Date of Patent: Mar. 2, 2004

(54) SELECTION MANIFOLD FOR BEVERAGE DISPENSER

(75) Inventors: Jerry L. Landers, Memphis, IN (US); M. Scott Bennett, Louisville, KY (US); Hershel E. Fancher, New Albany, IN (US); Alan S. Lucas, Sellersburg, IN (US)

(73) Assignee: Manitowoc Foodservice Companies, Inc., Sparks, NV (US)

( * ) Notice: Subject to any disclaimer, the term of this patent is extended or adjusted under 35 U.S.C. 154(b) by 0 days.

(21) Appl. No.: 09/993,934

(22) Filed: Nov. 5, 2001

(65) Prior Publication Data

US 2002/0084284 A1 Jul. 4, 2002

Related U.S. Application Data

(63) Continuation-in-part of application No. 09/833,794, filed on Apr. 11, 2001.

(60) Provisional application No. 60/197,535, filed on Apr. 14, 2000.

(51) Int. Cl.[7] ..... B67D 5/56

(52) U.S. Cl. ..... 222/129.1; 222/144.5; 222/146.6

(58) Field of Search ..... 222/129.1, 129.2, 222/129.3, 129.4, 142.6, 144.5, 146.6; 137/884, 269, 270, 865.48

(56) References Cited

U.S. PATENT DOCUMENTS

| | | | | |
|---|---|---|---|---|
| 3,134,395 A | | 5/1964 | Glasgow | |
| 3,175,578 A | | 3/1965 | Patterson et al. | |
| 3,295,723 A | | 1/1967 | Welty | |
| 3,331,536 A | * | 7/1967 | Lorenzo | 222/108 |
| 3,347,421 A | | 10/1967 | Yingst et al. | |
| 3,654,960 A | * | 4/1972 | Kierman | 137/884 |
| 3,892,335 A | | 7/1975 | Schroeder | |
| 4,130,137 A | * | 12/1978 | Lane | 137/884 |
| 4,188,976 A | * | 2/1980 | Austin, Jr. | 137/637.1 |
| 4,476,897 A | | 10/1984 | Morrill | |
| 4,615,466 A | | 10/1986 | Credle, Jr. | |

(List continued on next page.)

FOREIGN PATENT DOCUMENTS

| | | | | |
|---|---|---|---|---|
| DE | 19825954 A1 | | 12/1998 | |
| EP | 0344908 A1 | | 12/1989 | |
| EP | 0543741 | | 5/1993 | |
| GB | 2301580 A | | 12/1996 | |
| GB | 9712364.0 | | 6/1997 | |
| GB | 9726515.1 | | 12/1997 | |
| GB | 2326206 A | | 12/1998 | |
| WO | WO 91/17948 | | 11/1991 | |
| WO | WO-99/31007 | * | 6/1999 | B67D/1/08 |

*Primary Examiner*—Gene Mancene
*Assistant Examiner*—Frederick C. Nicolas
(74) *Attorney, Agent, or Firm*—Brinks Hofer Gilson & Lione

(57) ABSTRACT

A selection manifold for use for use with a beverage dispenser apparatus for dispensing both carbonated and non-carbonated beverages and including a plurality of dispensing valves with a syrup and a water line feeding each dispensing valve further comprising a selection manifold connected between at least one of the water lines and sources of both carbonated and non-carbonated water, the manifold having a selecting mechanism allowing a user of the apparatus to easily switch between directing carbonated and non-carbonated water through the water line to the dispensing valve. In a preferred embodiment, the selection mechanism includes a portion that enables a viewer to easily determine whether carbonated or non-carbonated water is selected. In another preferred embodiment, the selection mechanism includes a lock to prevent inadvertent switching of the mechanism.

14 Claims, 13 Drawing Sheets

U.S. PATENT DOCUMENTS 4,641,763 A 2/1987 Landers et al.
4,765,513 A * 8/1988 McMillin et al. ..... 222/129.1
4,781,309 A 11/1988 Vogel
4,913,183 A 4/1990 Vogel et al.
4,921,140 A 5/1990 Belcham
4,979,639 A 12/1990 Hoover et al.
5,033,645 A 7/1991 Shannon et al.
5,115,942 A 5/1992 Merrill et al.
5,125,431 A 6/1992 Vogel et al.
5,249,710 A 10/1993 Hassell et al.
5,335,819 A * 8/1994 Martin ..... 222/146.6
5,341,846 A * 8/1994 Framberg ..... 137/884
5,343,716 A * 9/1994 Swanson et al. ..... 62/389
5,397,032 A * 3/1995 Landers ..... 222/146.6
5,433,349 A 7/1995 Romanyszyn, Jr.
5,447,176 A * 9/1995 Asou et al. ..... 137/625.66
5,499,744 A 3/1996 Hawkins
D390,058 S 2/1998 Landers
5,765,591 A 6/1998 Wasson et al.
5,881,922 A 3/1999 Hawkins et al.
5,931,348 A 8/1999 Guadalupi
5,954,235 A 9/1999 Schroeder et al.
5,984,142 A 11/1999 Castaldi
6,192,935 B1 2/2001 Schroeder et al.
6,286,721 B1 9/2001 Pellegrini
6,328,070 B2 * 12/2001 Clayton et al. ..... 137/884
6,375,042 B1 4/2002 Goodwin

* cited by examiner 510
512
513
514
517
518
518
519
520
522
523
524
525
526
610
612
618
618
623
625
636

SELECTION MANIFOLD FOR BEVERAGE DISPENSER

REFERENCE TO EARLIER FILED APPLICATION

The present application claims the benefit of the filing date under 35 U.S.C. §119(e) of provisional U.S. Patent Application Ser. No. 60/197,535, filed Apr. 14, 2000, and is a CIP of U.S. patent application Ser. No. 09/833,794, filed Apr. 11, 2001, both of which are hereby incorporated by reference.

BACKGROUND OF THE INVENTION

The present invention relates to a selection manifold for a beverage dispenser, such as a post-mix carbonated beverage dispensing system.

A post-mix carbonated beverage dispensing system makes its own carbonated water from a supply of municipal or well water, and then distributes the carbonated water to a plurality of post-mix valves. Each post-mix valve mixes carbonated water with syrup and effects dispensing of a complete beverage. These dispensers are typically found in fast food retailers, theaters, convention centers, sports facilities and the like, and are most often used to fill cups with beverage.

Most all of these plural flavor post-mix dispensers have some type of structure to distribute carbonated water from a single source which may be single or plural carbonator to a plurality of dispensing valves. There typically will be a minimum of four dispensing valves, and it is common to see up to twelve dispensing valves being supplied from a single carbonator.

Recently, consumers have desired the option of purchasing non-carbonated beverages at locations served by post-mix carbonated beverage systems. As a result, manufactures of such beverage dispensing systems have started to provide one or more valves that are connected to a source of chilled but non-carbonated water. These valves then mix a syrup with the non-carbonated water to provide a non-carbonated drink, such as lemonade.

While this additional consumer choice is good for the establishment selling the beverages, it causes problems for the equipment manufacturers and suppliers. Heretofore, the equipment has been built with a fixed number and position of valves that that are supplied with non-carbonated water. The problem is that consumer preferences change, or are unknown at the time equipment has to be purchased and installed. Thus, a beverage dispenser may be installed at a location with only one valve configured to dispense a non-carbonated beverage. However, in actual use, it may be determined that consumers would rather have other types of non-carbonated beverages than the type of carbonated beverage being dispensed. If a user wanted a different selection, so that more valves can dispense non-carbonated beverages, or wants to move the position of the dispenser valves from which non-carbonated beverages are dispensed, the beverage dispensing equipment would have to be modified. While this is difficult and expensive at best, it may be impossible in some systems because the systems are built so that the water (carbonated or non-carbonated) lines are insulated right up to the point where they attach onto the dispensing valves. Therefore, any change would require a complete tearing apart of the equipment.

To add flexibility to beverage dispensers, valve systems have been developed that allow a single dispensing valve to serve either carbonated or non-cabonated beverages. For example, post-mix valves are disclosed in U.S. Pat. No. 5,984,142 to Castaldi and U.S. Pat. No. 5,931,348 to Guadalupi. These systems are switchable, such that either carbonated or non-carbonated water will be delivered by a given dispensing valve. While these post-mix valves provide dispensing valves that can be adjusted at a customer site, neither system enables the valves to be secured in position so as to prevent unintentional switching from one type of water to the other. Further, neither system allows an inspector to easily determine whether a given valve is positioned to deliver carbonated or non-carbonated water.

Thus, there is a need for an improved beverage dispensing equipment that is more versatile, so that an equipment user can more easily change the configuration of the equipment so that different types of beverages can be dispensed as consumer preferences are learned or change.

SUMMARY OF THE INVENTION

A selection manifold has been invented for use with a beverage dispenser that allows the user to easily change the dispenser's configuration. In the preferred embodiment, any dispensing valve on a dispenser can be converted from dispensing a carbonated beverage to a non-carbonated beverage. Additionally, the preferred selection manifold is preferably constructed to enable a selection mechanism to be locked into position to prevent inadvertent switching to a non-selected supply line. Also, the selection manifold is preferably configured to permit ready determination of the status of each selection mechanism in the manifold.

In one aspect, the invention is a selection manifold for use with a beverage dispenser comprising:

a) a manifold block containing at least one cell, each cell having an outlet opening and at least first and second inlet openings; and b) a selector mechanism associated with each cell, the selector mechanism being actuable between i) a first position in which fluid entering the cell from the first inlet opening may pass to the outlet opening and fluid from the second inlet is prevented from entering the cell, and ii) a second position in which fluid entering the cell from the second inlet opening may pass to the outlet opening and fluid from the first inlet opening is prevented from entering the cell.

In a first aspect, the foregoing selector mechanism includes a lock to prevent the unintentional change of the selector mechanism between the first and second positions. In another aspect, the foregoing selector mechanism includes a portion that extends past and an outer edge of the manifold block enabling a viewer to determine the position of the selector mechanism associated with each cell.

In another aspect, a beverage selection manifold comprises:

a) a cell within a manifold body, the cell including an outlet orifice and first and second inlet orifices; and b) a removable cap including a channel therein positionable adjacent to the cell in a first cap position and a second cap position, wherein the channel allows fluid communication between the outlet orifice and the first inlet orifice in the first position and the outlet orifice and the second inlet orifice in the second position. the selector mechanism comprises a cap with a channel.

In yet another aspect, a selection manifold for use with a beverage dispenser comprises:

a) a manifold block containing at least one cell, each cell having an outlet opening positioned intermediate to first and second inlet openings; and b) a selector mechanism associated with each cell, wherein the selector mechanism comprises a plunger valve having a seal, the seal of the selector mechanism being transversely actionable with respect to the outlet opening between i) a first position in which fluid entering the cell from the first inlet opening may pass to the outlet opening and fluid from the second inlet is prevented from entering the cell, and ii) a second position in which fluid entering the cell from the second inlet opening may pass to the outlet opening and fluid from the first inlet opening is prevented from entering the cell.

In a further aspect, a beverage selection manifold comprises:

a) a manifold block containing an outlet opening positioned intermediate to first and second opposed inlet openings; and b) a fluid seal having a first seating surface opposite a second seating surface, wherein the fluid seal is moveable to a first position in which the first seating surface seals the first inlet opening and the second inlet opening remains open, and to a second position in which the second seating surface seals the second inlet opening and the first inlet opening remains open.

In a first method, switching a supply line to a dispensing valve comprises a user selecting the fluid supply to a beverage valve by activating a fluid seal between a first position in which a first side of the fluid seal closes a first fluid supply line, while allowing fluid to flow through a second fluid supply line, and a second position in which a second side of the fluid seal closes the second fluid supply line, while allowing fluid to flow through the first fluid supply line.

In another method of practicing the invention, switching a supply line to a dispensing valve includes a user selecting the fluid supply to a beverage valve by positioning a cap in a first position in which a first side of the cap closes a first fluid supply line, while allowing fluid to flow through a second fluid supply line, and a second position in which a second side of the cap closes a second fluid supply line, while allowing fluid to flow through the first fluid supply line.

The invention and its advantages will best be understood in view of the attached drawings.

DETAILED DESCRIPTION OF THE DRAWINGS AND PREFERRED EMBODIMENTS OF THE INVENTION

Figure 1:
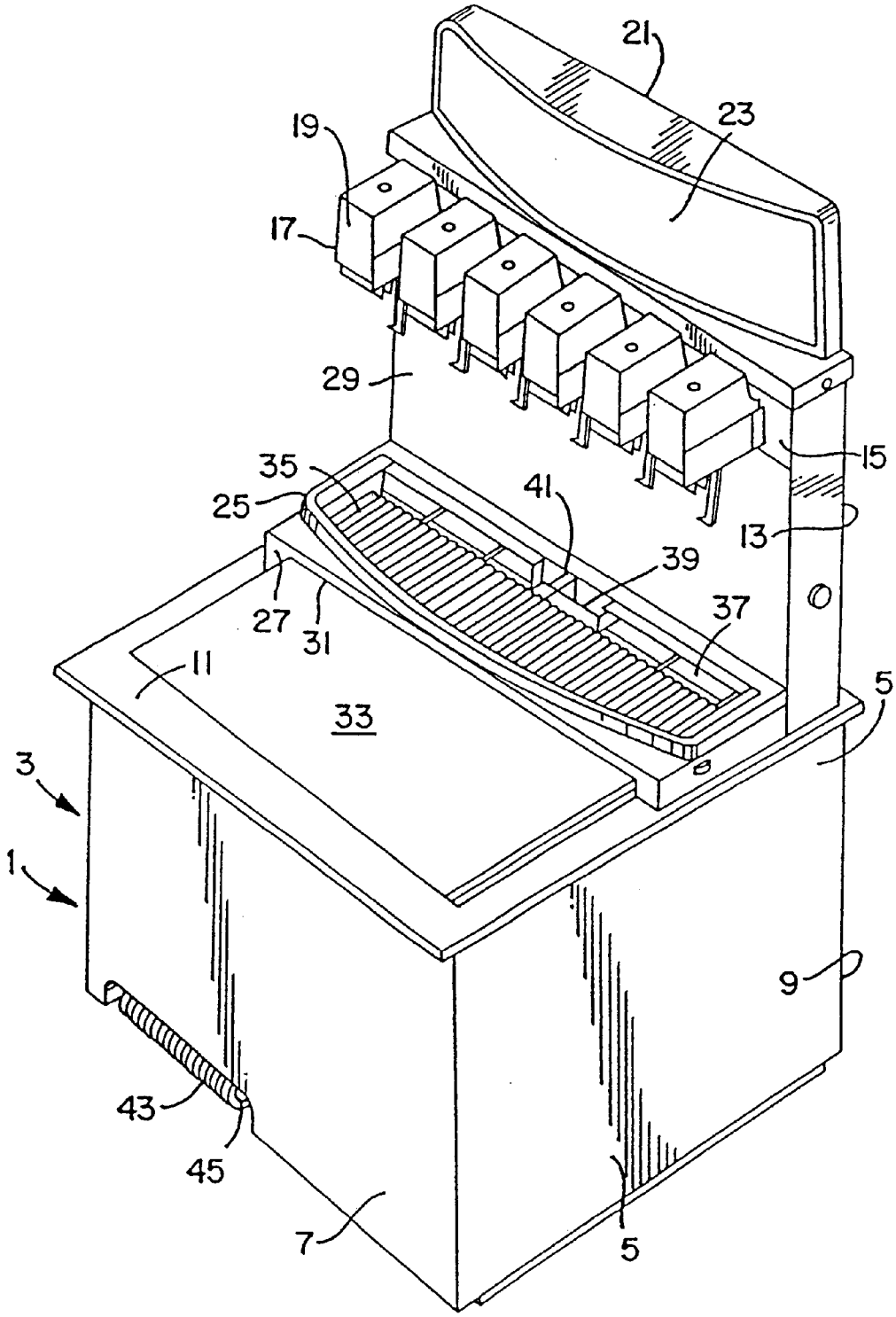
FIG. 1 is a perspective view of a combined ice and beverage dispenser, utilizing the preferred embodiment of the present invention.

Referring now to FIG. 1, a beverage and ice dispenser utilizing the present invention is generally indicated by the numeral 1. The dispenser has a cabinet or box 3 which has side walls 5, a front wall 7 and a rear wall 9. A trim ring 11 covers the top of the cabinet and covers an opening in a counter in which the dispenser is installed. A tower 13 extends upward from the top of the cabinet. The tower has plural dispenser valves 15 arranged in a line along the front. The valves have levers 17 which may be moved to open the valves for mixing carbonated or non-carbonated water with flavored syrups to produce the desired soft drinks. Alternatively, the valves may be operated by pushing the front faces 19 of the valves.

A large curved merchandiser advertisement 21 appears at the top of the tower. The merchandiser is backlit and has a translucent front panel 23 on which a message appears.

A drain pan 25 below the valves catches overflows from the cups under the valves and ice which is spilled from overfilled cups. The drain pan 25 is mounted on top of the trim ring 11. Lifting up on the front 27 of the drain pan and pulling upward on the drain pan removes the drain pan from the top of the cabinet 3. Lifting or sliding the splash panel 29 upward allows the splash panel to be rocked away from the tower for cleaning. The drain pan 25 has a rectangular opening 31 in its front 27, through which the ice bin door 33 slides or rotates. After the drain pan has been removed, lifting the front edge of the sliding door upward 33 and tiling the door rearward enables the door to be removed from holders at the sides. In that manner, full access is supplied to the ice storage bin for cleaning the bin and the top of the cold plate, which is integral with the bin. The dispenser may be removed from the counter top by lifting upward on the supporting flanges, which are covered by the trim ring 11.

Figure 2:
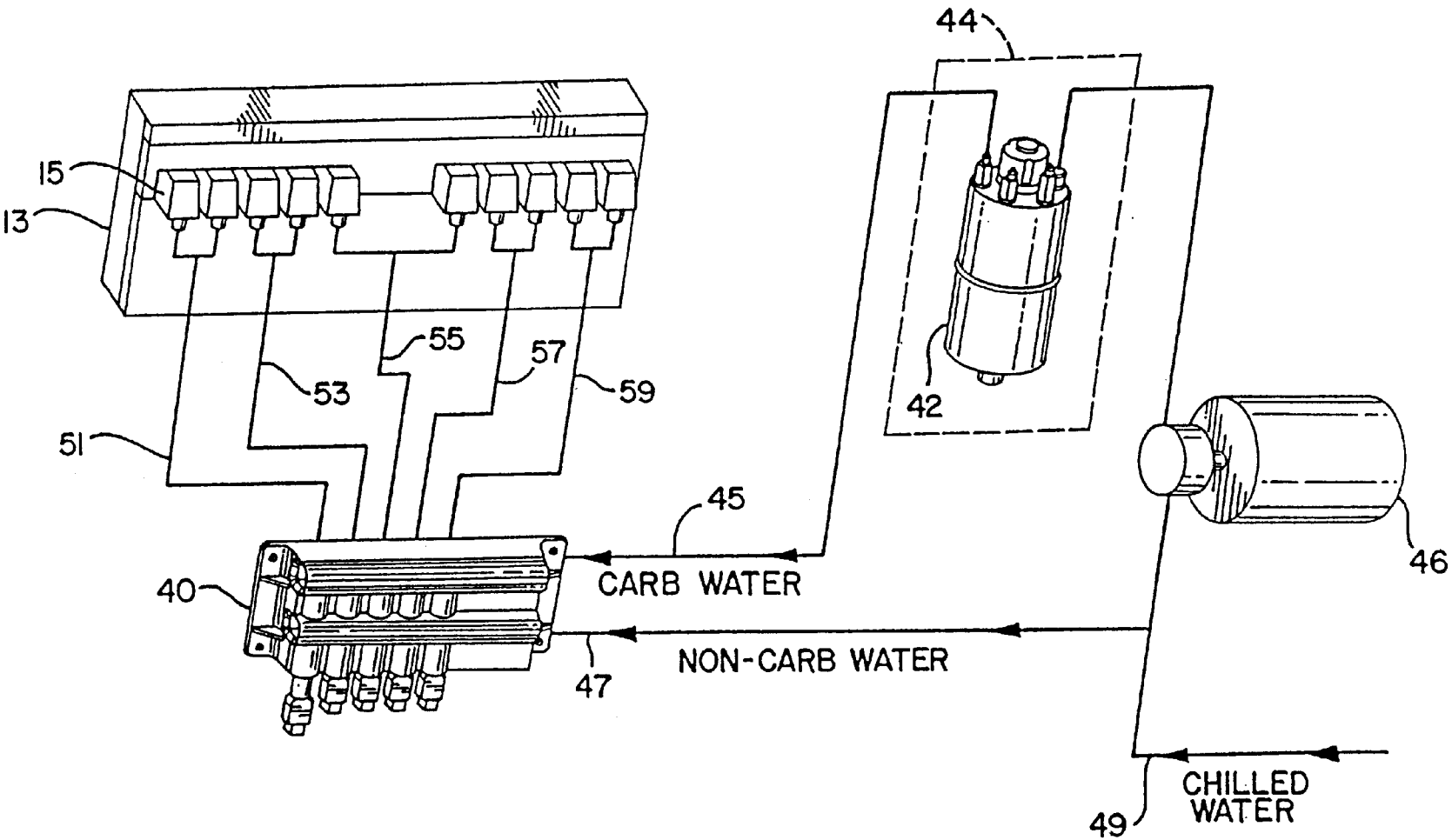
FIG. 2 is a schematic representation of the water system used in the beverage dispenser of FIG. 1, showing the preferred selection manifold.
Figure 4:
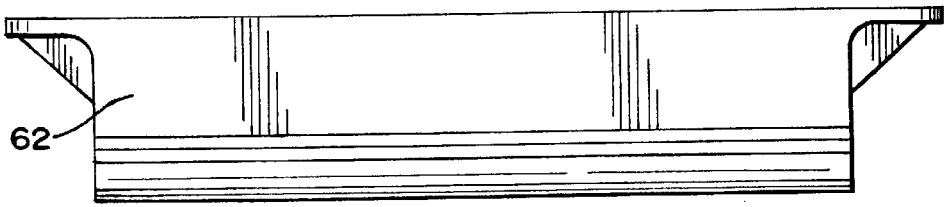
FIG. 4 is a top plan view of the selection manifold of FIG. 2.

In the above mentioned respects, the beverage and ice dispenser of the present invention is like prior art beverage and ice dispensers, such as those disclosed in U.S. Pat. Nos. 5,397,032 and 4,641,763, which are hereby incorporated by reference. The beverage and ice dispenser 1 however includes a unique selection manifold 40 as shown in FIG. 2. FIG. 2 also shows a carbonator 42 which is disposed in a chilled zone 44 and a carbonator pump 46. In the embodiment depicted, a carbonated water line 45 and a non-carbonated water line 47 both feed the selection manifold 40, chilled water being supplied to system by line 49. Five water lines 51, 53, 55, 57 and 59 extend between the selection manifold 40 and the dispensing valves 15 on the tower 13. In the embodiment depicted in FIG. 2, there are ten dispensing valves 15, and thus each of water lines 51, 53, 55, 57 and 59 branches to feed two dispensing valves.

It would of course be possible to increase the size of the selecting manifold 40 and the number of water lines so that each dispensing valve 15 was supplied by its own water line coming from the selection manifold 40, or fewer lines could be used so that more valves could be paired together.

The carbonator 42, carbonator pump 46 and dispensing valves 15 can be of any of several known configurations, and are therefore not described in any further detail.

Figure 6:
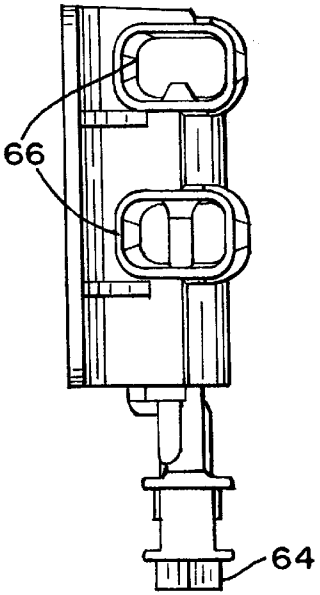
FIG. 6 is a left side elevational view of the selection manifold of FIG. 2.
Figure 7:
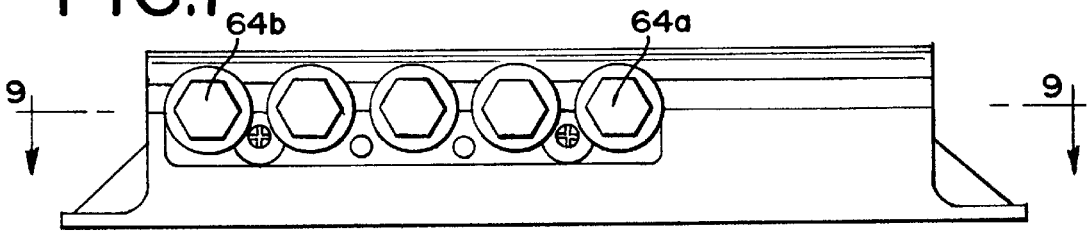
FIG. 7 is a bottom plan view of the selection manifold of FIG. 2.

The preferred selection manifold 40 is shown in detail in FIGS. 3–15. It is made with a manifold block, which in this embodiment is a valve body 62. The valve body may be injection molded from a thermoplastic material. The depicted valve body 62 has five cells, each containing a selection mechanism, which in this case is a shuttle valve member 64. Two specific shuttle valve members 64*a* and 64*b* will be discussed to explain the operation of the selection manifold 40. In one end (FIG. 6) the valve body includes channel plugs 66. Channels 60 and 66 in the valve body are made by core pins during the injection molding process. The holes through which those core pins are withdrawn must be plugged in some fashion. Besides the plugs 66, a cap could be secured to cover the end of the valve body.

In the back (FIG. 8) the valve body contains two inlets, 67 and 68, as well as an outlet 63 for each of the five cells within the body. The outlets are connected to water lines 51, 53, 55, 57 and 59. Inlet 67 is connected to non-carbonated water line 47 and inlet 68 is connected to carbonated water line 45 coming from carbonator 42 (FIG. 2).

Figure 9:
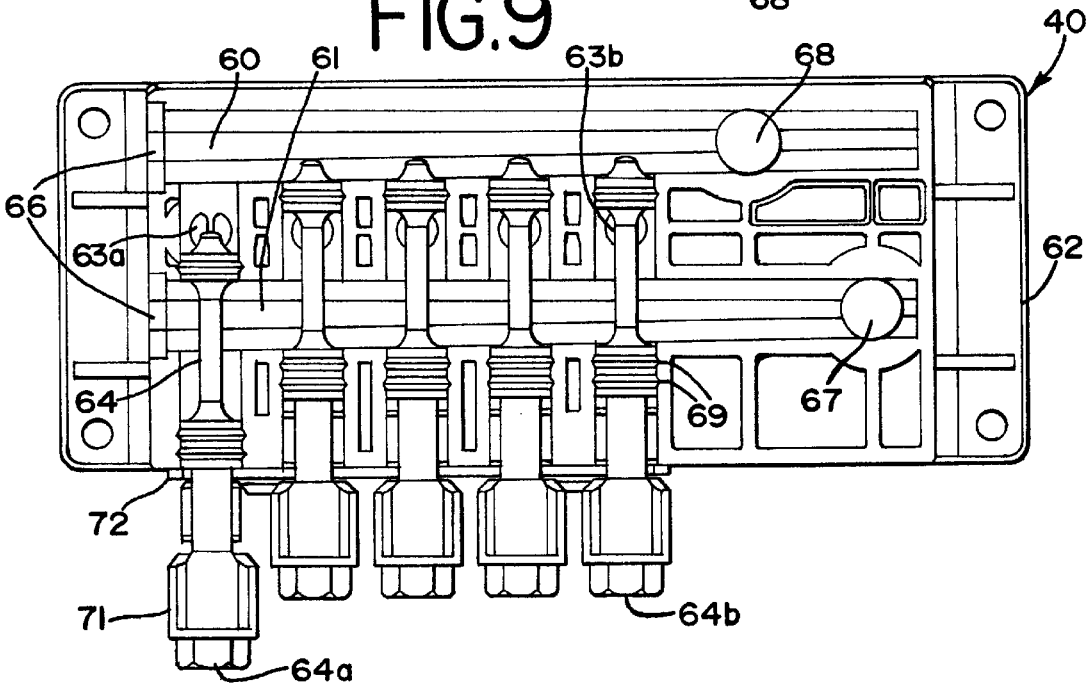
FIG. 9 is a cross-sectional view taken along line 9—9 of FIG. 7.
Figure 10:
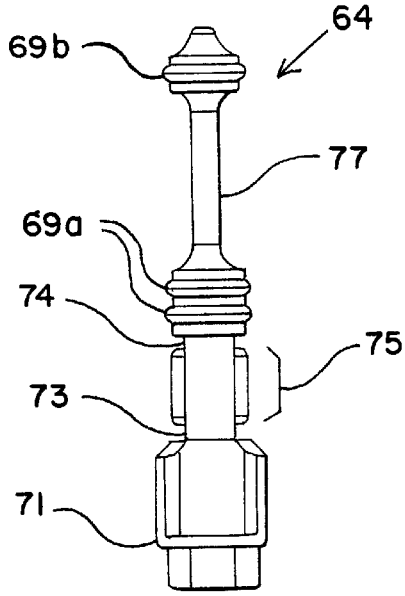
FIG. 10 is an elevational view of a shuttle valve member used in the selection manifold of FIG. 2.
Figure 11:
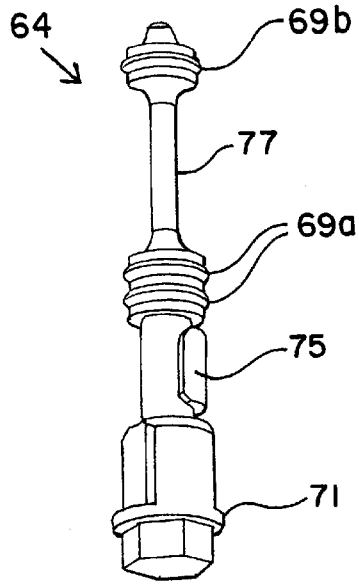
FIG. 11 is a perspective view of the shuttle valve member of FIG. 10.

As shown in FIG. 9, the shuttle valve members 64 are each fitted with three 0-rings 69. These 0-rings allow the shuttle valve member 64 to seal off any flow from the cell in which they are housed out the bottom of the valve body. Also, depending on their position, the 0-rings seal between the internal flow channels (60 and 61) and the outlets 63.

For example, when shuttle valve member 64*a* is in the position shown in FIG. 9, carbonated water entering the valve body 62 through inlet 68 is allowed to travel through channel 60 and exit through outlet 63*a*. On the other hand, shuttle valve member 64*b* allows non-carbonated water entering the valve body 62 through inlet 67 to travel through channel 61 and exit through outlet 63*b*. Of course, carbonated water in channel 60 cannot exit through any of the outlets 63 except 63*a*. Also, non-carbonated water in channel 61 is prevented from exiting outlet 63*a* by shuttle valve member 64*a*, with the 0-rings sealing inside the valve body 62.

Figure 12:
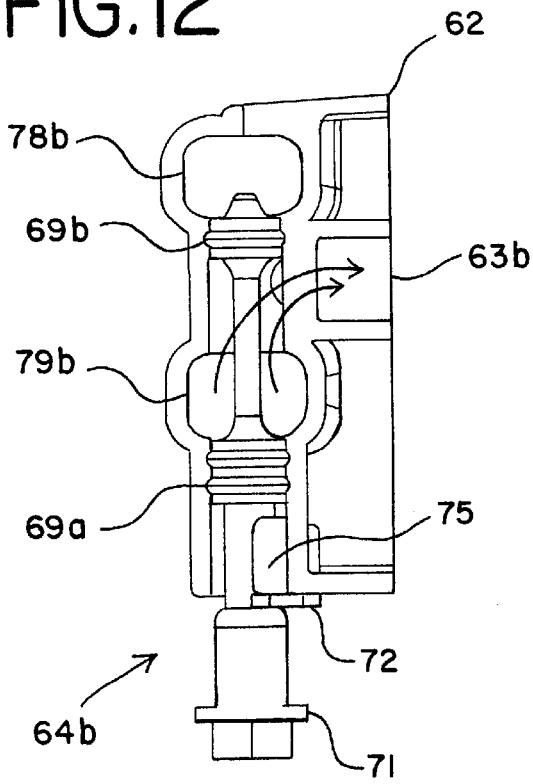
FIG. 12 illustrates the shuttle valve member of FIG. 10 in a position that allows fluid communication between the top flow channel (non-carbonated water) and the outlet orifice (dispensing valve).
Figure 13:
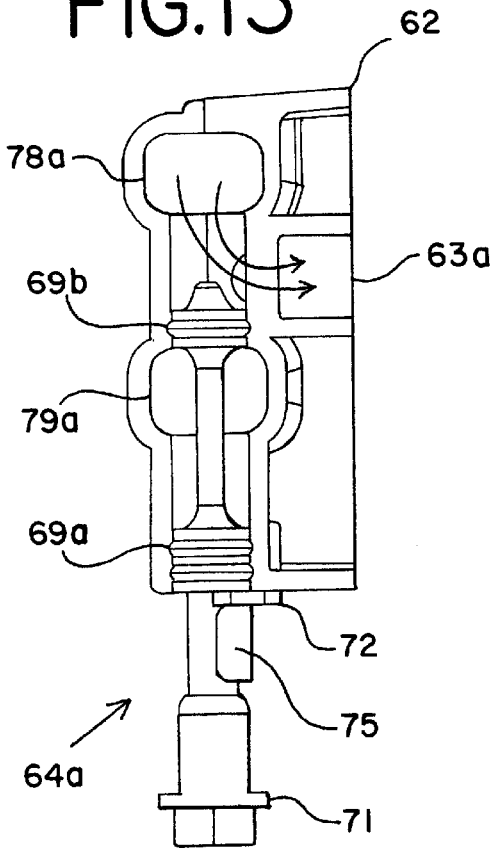
FIG. 13 illustrates the shuttle valve member of FIG. 10 in a position which allows fluid communication between the bottom flow channel (carbonated water) and the outlet orifice (dispensing valve).

To prevent the shuttle valve member 64 from being accidentally moved out of its desired position, either by an inadvertent force on the handle 71 of the shuttle valve member extending out of the valve body, or by differences in pressure between the two channels 60 and 61, a locking plate 72 (FIG. 9) is preferably provided. The locking plate 72 cooperates with locking grooves 73 and 74 and a retaining boss 75 formed on the shuttle valve member 64 and best seen in FIGS. 10 and 11. Locking groove 73 is used to lock the shuttle valve member in an "in" position, and locking groove 74 is used to lock the shuttle valve member 64 in an "out" position. The reduced diameter section 77 of the shuttle valve member allows for fluid to flow within the cell in which shuttle valve member 64 is placed, as shown in FIGS. 12 and 13. 0-rings 69*a* provide a lower sliding seal and 0-ring 69*b* provides an upper sliding seal. FIG. 12 shows the shuttle valve member set for non-carbonated water. The carbonated water inlet 78*a* into the cell is blocked by the upper sliding seal and 0-rings 69*b*. However, non-carbonated water can enter through inlet 79*b* and flow out the outlet 63*b*. FIG. 13 shows the valve set for carbonated water, which enters through inlet 78*a* and exits through outlet 63*a*. However, inlet 79*a* is blocked by 0-rings 69*b*. In both cases 0-rings 69*a* prevent water from leaking out the bottom of the valve body 62.

Figure 14A:
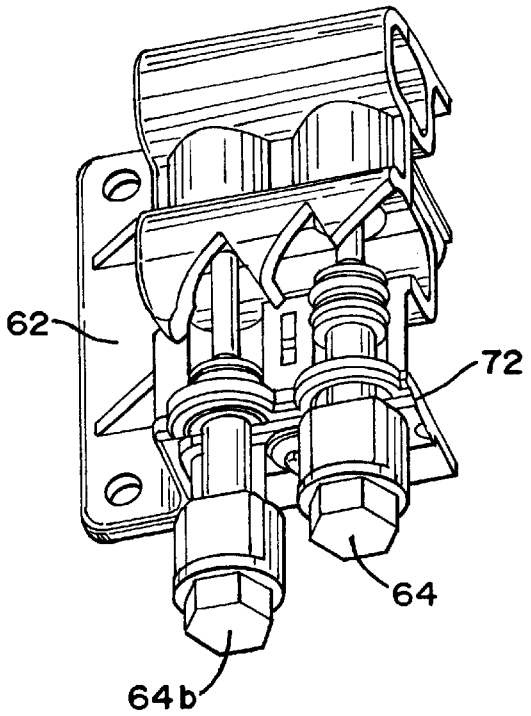
FIGS. 14A and 14B illustrate two adjacent shuttle valves members of FIG. 10 in a locked state.
Figure 14B:
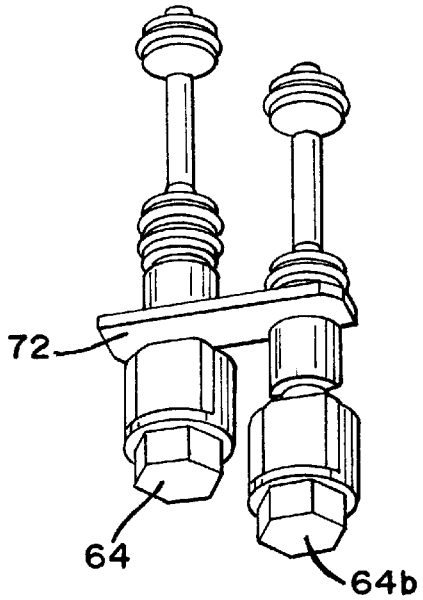
Figure 15A:
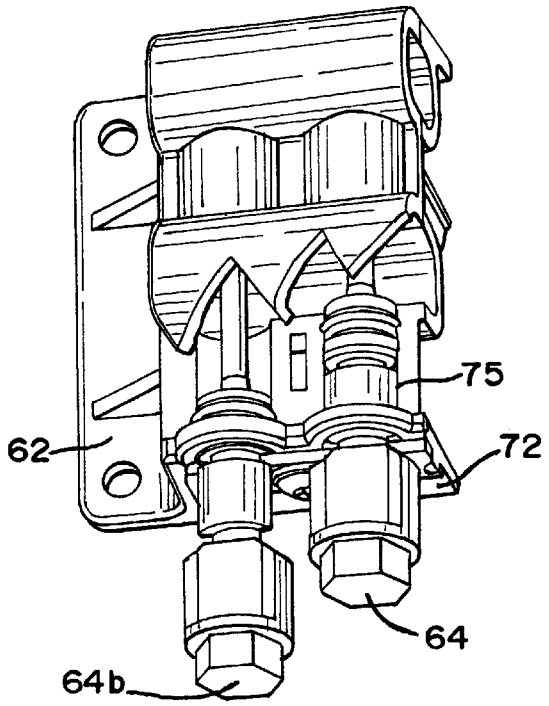
FIGS. 15A and 15B illustrate two adjacent shuttle valves member of FIG. 10 in an unlocked state.
Figure 15B:
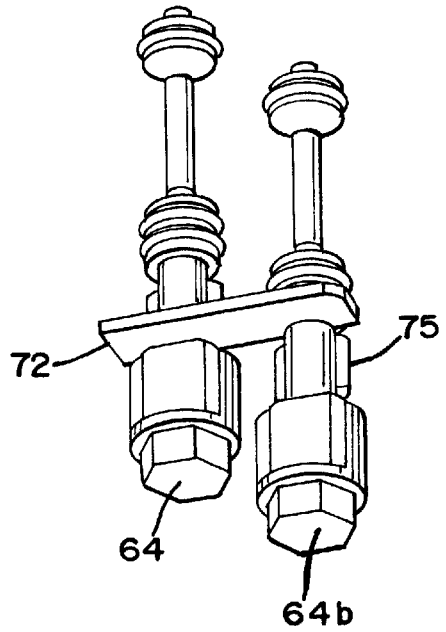

FIGS. 14A and 15A show the internal aspects of the valve body 62 and how the shuttle valve locking plate 72 is used. FIGS. 14B and 15B show just the locking plate 72 and the shuttle valve member 64. The locking plate 72 includes a boss or opening that allows the shuttle valve member to be retracted or extended when the valve is in one position, (FIGS. 15A and B) but when the shuttle valve member is rotated about its axis, such as by 180°, the retention boss 75 interferes with the locking plate, preventing the shuttle valve member from sliding in or out (FIGS. 14A and B).

Figure 3:
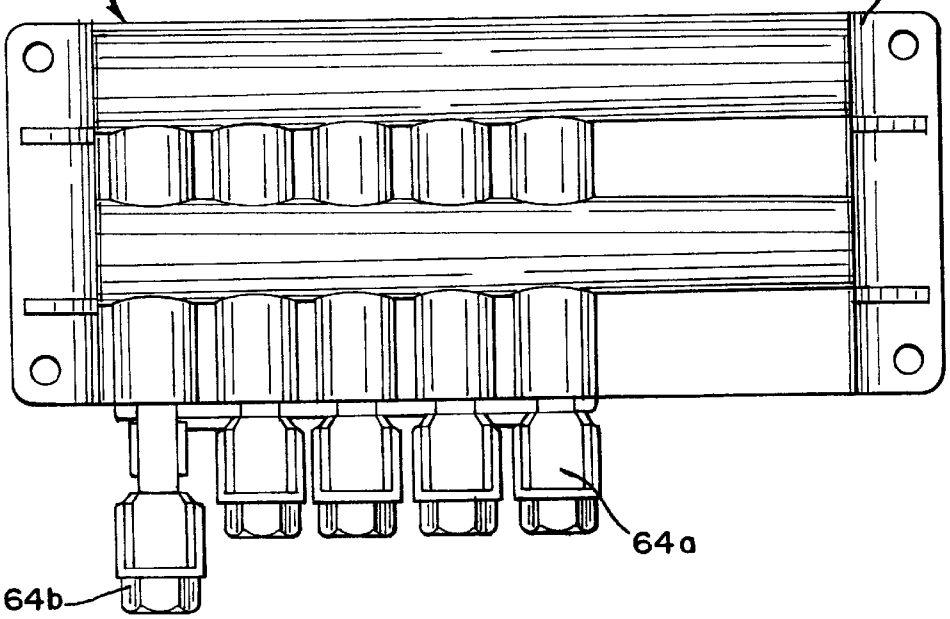
FIG. 3 is a front elevational view of the selection manifold of FIG. 2.
Figure 5:
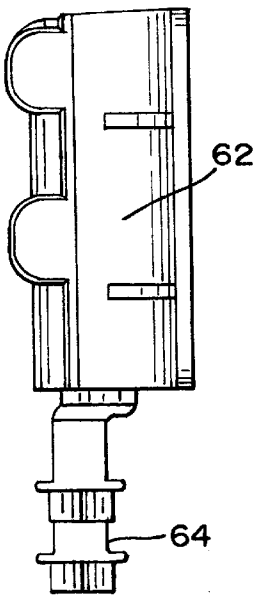
FIG. 5 is a right side elevational view of the selection manifold of FIG. 2.
Figure 8:
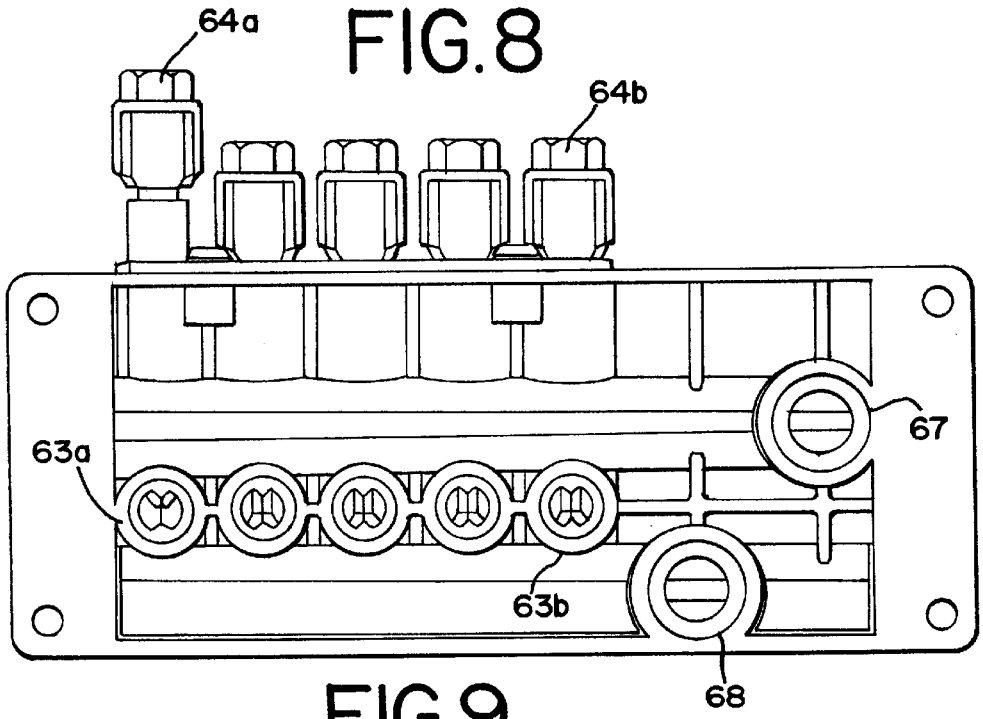
FIG. 8 is a back elevational view of the selection manifold of FIG. 2.

As shown in FIGS. 3, and 8–9, each handle 71 extends past the outer edge of selection manifold 40. By providing a section of each shuttle valve 64 that is visible after the selection manifold is mounted to a dispenser, an inspector can easily determine the position of each valve. This feature of the invention is a distinct advantage over prior art systems that require detailed inspection or sampling to determine whether carbonated or non-carbonated water is selected.

Figure 16:
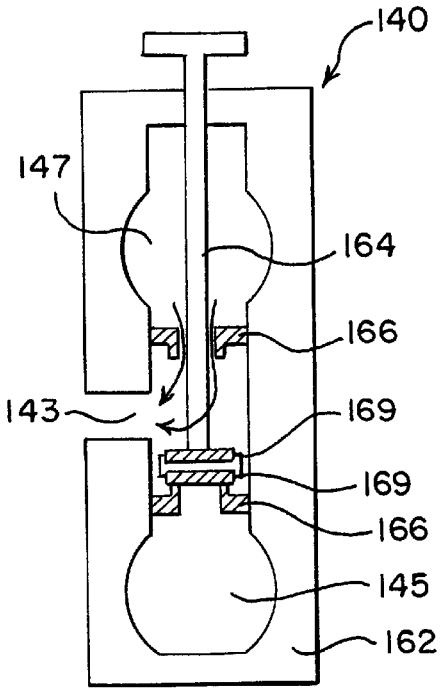
FIG. 16 is a schematic view of a second embodiment of a selection manifold of the present invention in the non-carbonated water position.
Figure 17:
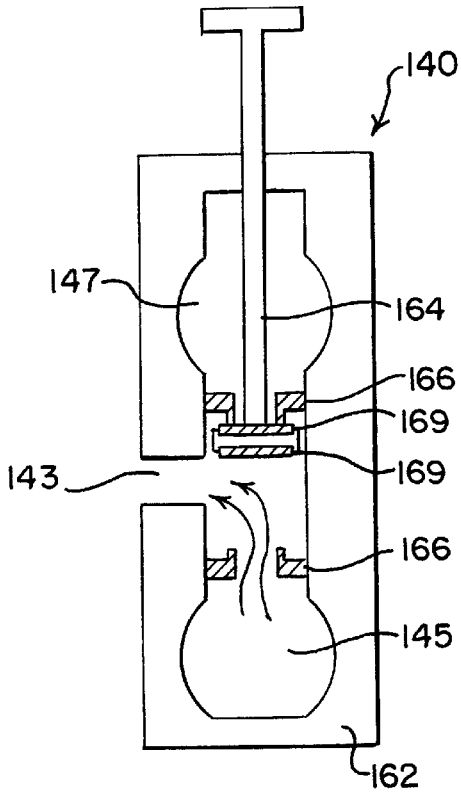
FIG. 17 is a schematic view of the selection manifold of FIG. 16 in the carbonated water position.
Figure 18:
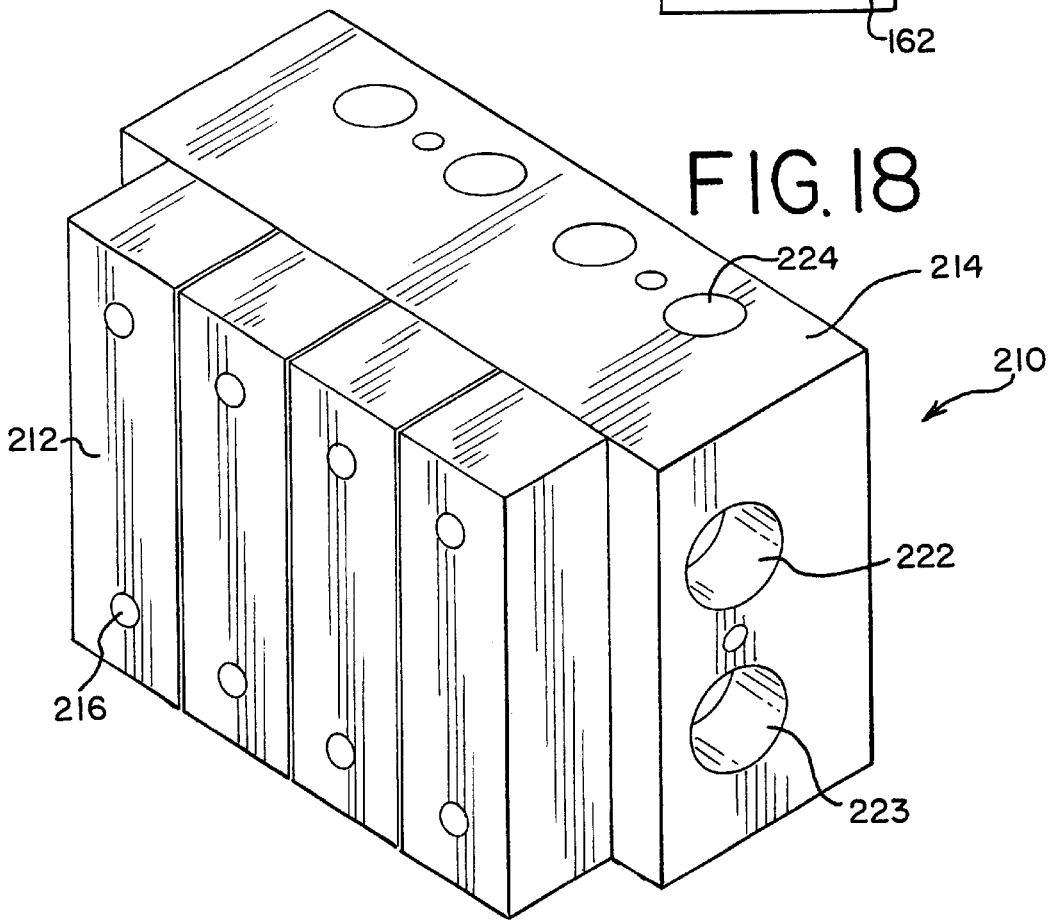
FIG. 18 is a perspective view of a third embodiment of a selection manifold of the present invention which utilizes a selector cap to control the desired fluid connection path.
Figure 20:
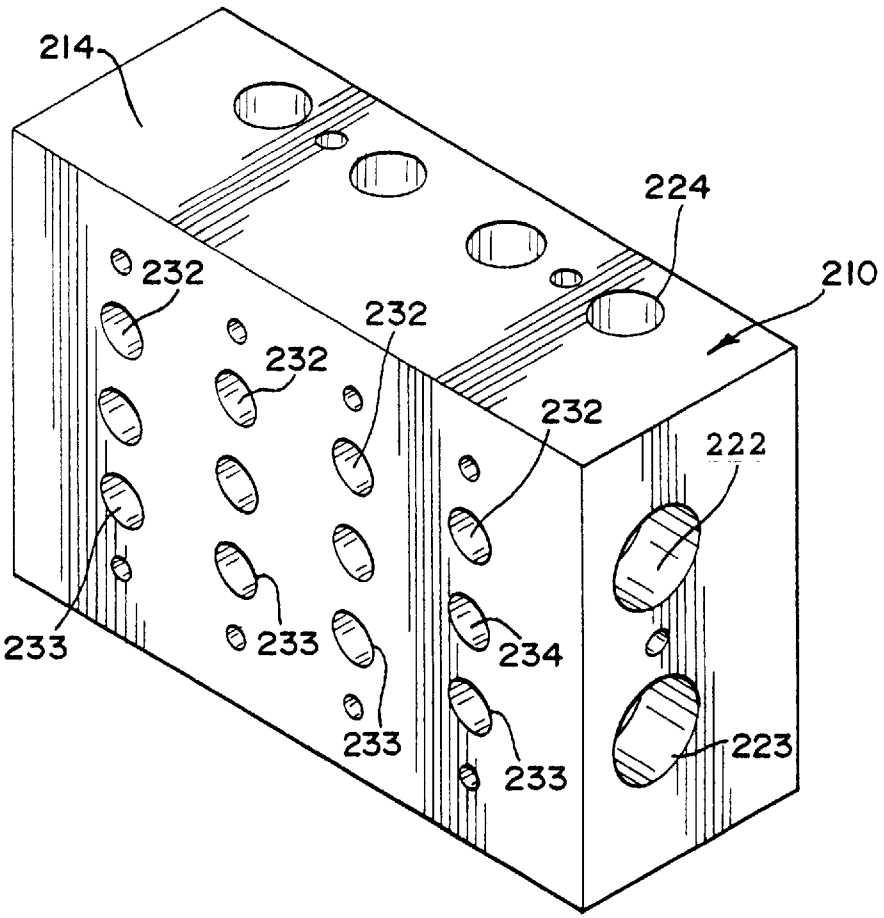
FIG. 20 is a perspective view of the selection block used in the selection manifold of FIG. 18.
Figure 19:
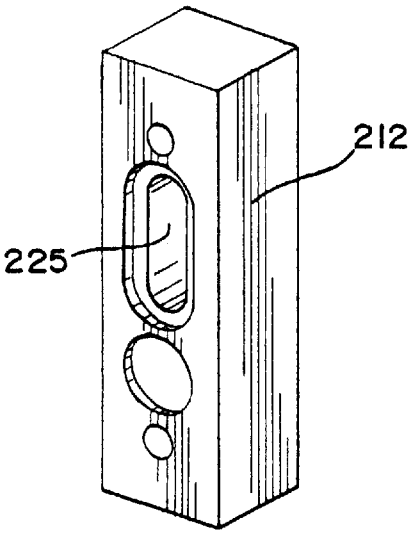
FIG. 19 is a perspective view of selector cap used in the selection manifold of FIG. 18.

A second embodiment of a selection manifold 140 is shown in FIGS. 16 and 17. This embodiment uses a direct acting plunger inside the cell within the manifold body 162. Sealing washers 169 are used to seal against valve seats 166. In the position shown in FIG. 16, non-carbonated water 147 can flow out of outlet 143. In the position shown in FIG. 17, carbonated water 145 can flow out of outlet 143. In similarity to the foregoing embodiment, the position of stem 164, and hence, the position of the valve, can be easily determined by simply viewing selection mainifold 140.

Those skilled in the art will appreciate that the selector mechanisms described above utilize a sealed valve system. Accordingly, when switching from one supply line to another, there is no need to relieve the pressure in the supply lines prior to changing the valve position. By eliminating the need to depressurize supply lines, numerous time-consuming procedures, such as turning power supplies off and on and bleeding supply lines can be avoided. Further, spillage of water, which can damage counter tops and cabinets is also avoided.

A third embodiment of a selection manifold 210 is shown if FIGS. 18–22. In this embodiment the selection mechanism is a selector cap 212 that is held onto the manifold body 214 by retention screws 216. The body 214 has two inlets 222 and 223 and an outlet 224 for each cell in the body. Holes 232 in the face of the body connect with a flow channel extending inwardly from inlet 222. Holes 233 also in the face of the body connect with a flow channel extending inwardly from inlet 223. Each cell also has another hole 234 in the face of the body, connecting with the outlet 224 for the cell.

Figure 21:
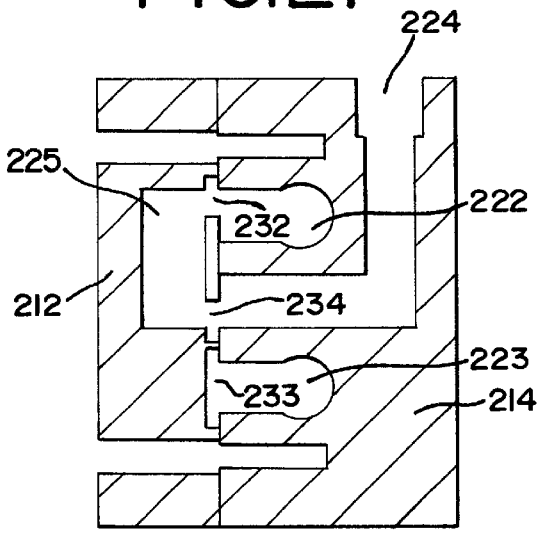
FIG. 21 is a cross-sectional view of the selection manifold of FIG. 18 which illustrates the selector cap positioned to supply non-carbonated water to the dispensing valve.
Figure 22:
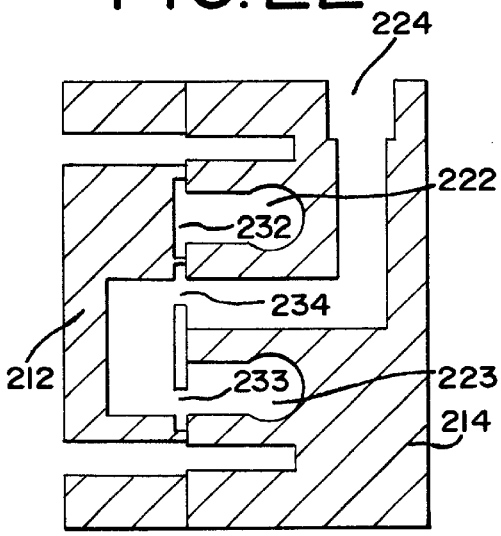
FIG. 22 is a cross-sectional view of the selection manifold of FIG. 18, which illustrates the selector cap positioned to supply carbonated water to the dispensing valve.

The selector cap 212 has an elongated channel 225 in one face. This channel does not open to any other face of the cap. The channel 225 extends from the center of the face off to one side by a distance equal to the distance between holes 232 and 234 (or holes 233 and 234) in the face of the manifold body 214. FIGS. 21 and 22 show the cap 212 attached to the face of the body 214. In one position, FIG. 21, non-carbonated water from inlet 222 is able to pass through the cell to the outlet 224, while carbonated water from inlet 223 is blocked. In the position shown in FIG. 22, carbonated water is allowed to pass through the cell in the selection manifold. As readily seen in FIGS. 18–22, cap 212 is repositioned on manifold body 214 by flipping the cap over and reattaching retention screws 216.

Figure 23:
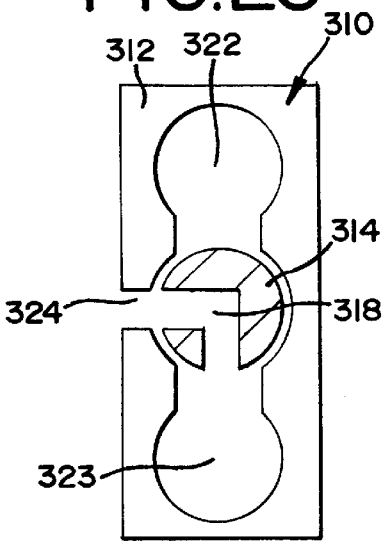
FIG. 23 is a schematic view of a fourth embodiment of a selection manifold of the present invention positioned to supply carbonated water to the dispensing valve.
Figure 24:
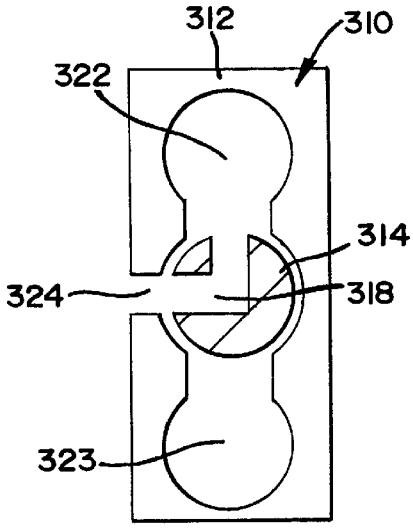
FIG. 24 is a schematic view of the selection manifold of FIG. 23 positioned to supply non-carbonated water to the dispensing valve.

A fourth embodiment of the selection manifold 310 of the present invention is shown in FIGS. 23 and 24. The manifold has a body 312 and a selector mechanism which comprises a rotating stop cock or ball valve 314. Depending on the position of the ball valve 314, carbonated water from inlet 323 (FIG. 23) on non-carbonated water from inlet 322 (FIG. 24) is permitted to flow through internal channel 318 to outlet 324.

Figure 26:
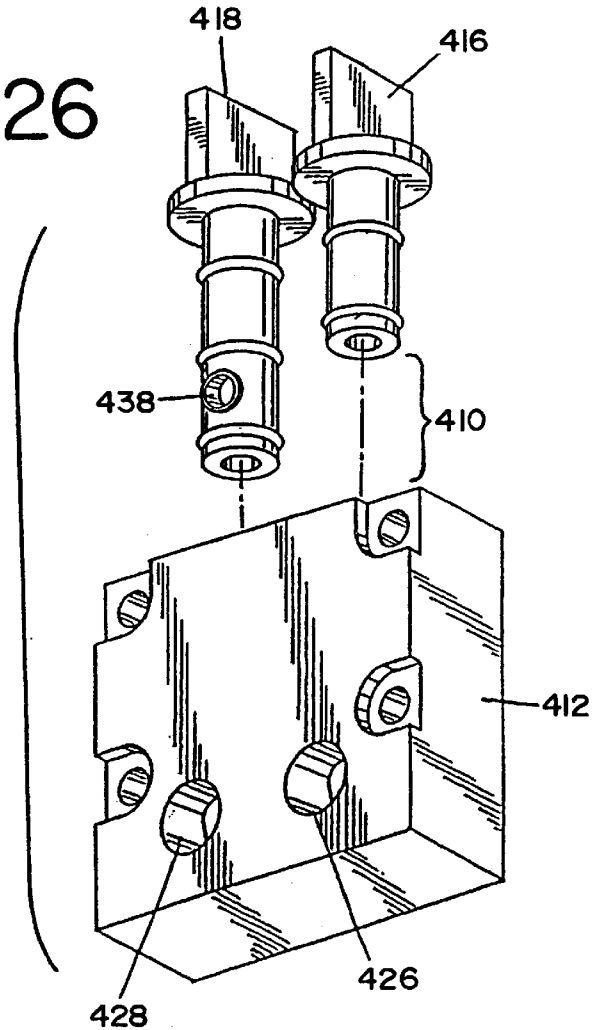
FIG. 26 is a perspective, exploded view of the selection manifold of FIG. 25.
Figure 25:
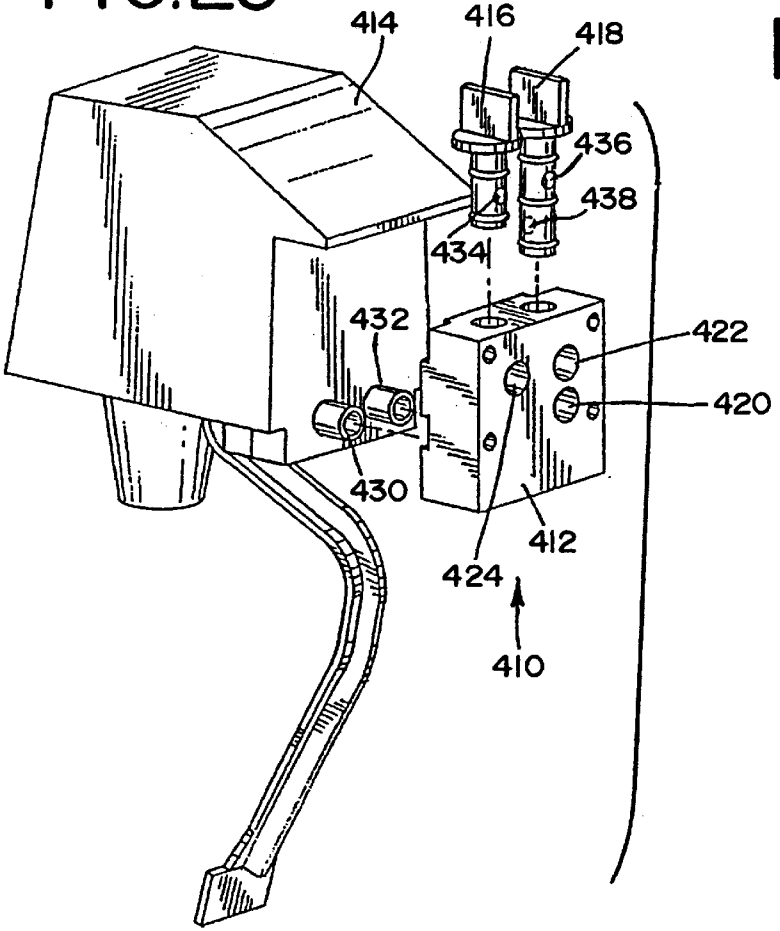
FIG. 25 is an exploded view of a fifth embodiment of a selection manifold for use on a single post-mix beverage dispensing valve.

A fifth embodiment of a selection manifold 410 is shown in FIGS. 25–26. In this embodiment the selection manifold is built into a mounting block 412 used to mount a post-mix beverage dispensing valve 414 onto a beverage dispenser. A two-way syrup valve 416 and a three-way water valve 418 fit in the mounting block 412. Carbonated water enters the block 412 through port 420. Non-carbonated water enters the block through port 422. Syrup enters the block through port 424. The stem of each of valves 416 and 418 have a channel through their center, open at the bottom, that communicates respectively with syrup outlet port 426 and water outlet port 428 on block 412, which connect onto fittings 430 and 432 on the back of mixing valve 414. The syrup valve 416 has only one inlet 434, scaled with an O-ring (not shown). The water valve 418 has two inlets 436 and 438 when the valve 418 is inserted into mounting block 412 in the position shown in FIGS. 25 and 26, inlet 436 mates with port 422 so that non-carbonated water flows through the selection manifold 410. If the valve 418 is rotated 180°, inlet 438 mates with port 420, and carbonated water flows through selection manifold 410.

Figure 27:
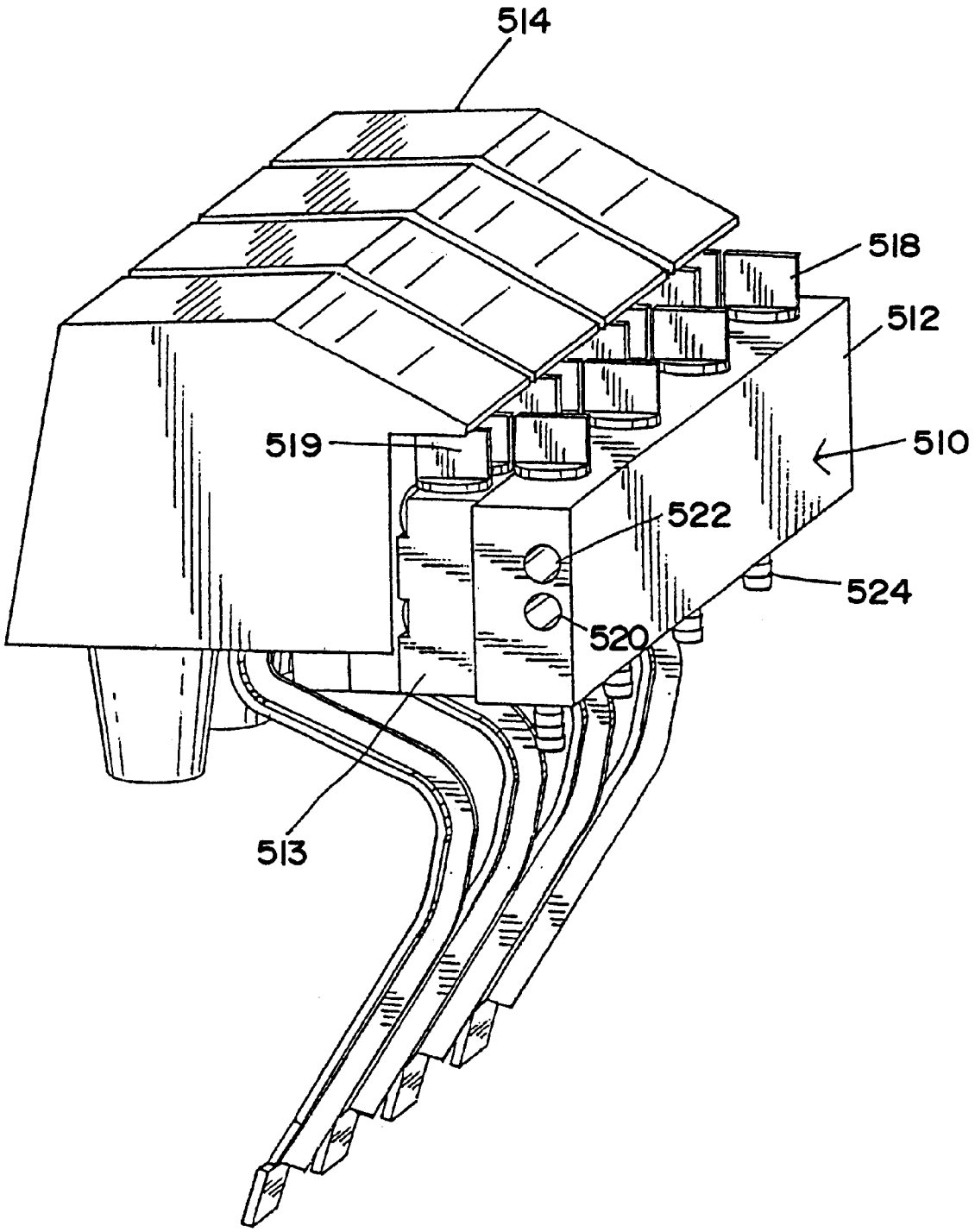
FIG. 27 is a perspective view of a sixth embodiment of a selection manifold and mounting blocks for use with multiple post-mix beverage dispensing valves.
Figures 28, 30:
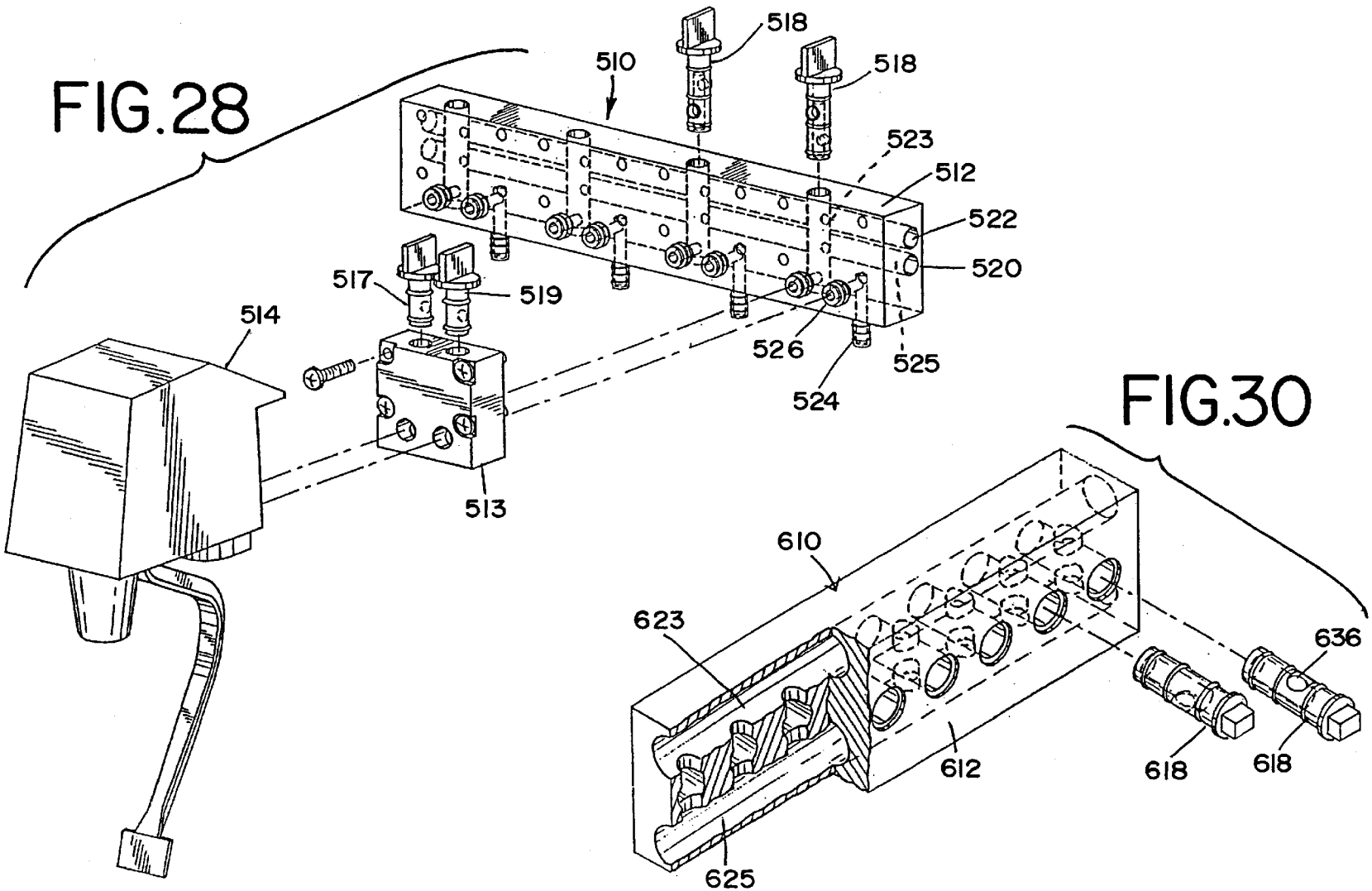
FIG. 28 is an exploded view of the selection manifold of FIG. 27 showing only one mounting block and post-mix beverage dispensing valve.
FIG. 30 is an exploded, partial cross-sectional view of the selection manifold of FIG. 29.

A sixth embodiment of a selection manifold 510 is shown in FIGS. 27–28. This selection manifold consists of four sets of water and syrup valves in one block 512. Each set is configured like the valves 416 and of FIG. 25. The entire manifold 510 also acts as a mounting block to mount multiple post-mix beverage dispensing valves 514 to a beverage dispensing machine. Individual valve blocks 513, with simple two-way valves 517 and 519, are mounted on the back of each post-mix dispensing valve 514. These valve blocks 513 allow water and syrup flow to be shut off to the valves 514. The selection manifold has one inlet port 520 for carbonated water and one inlet port 522 for non-carbonated water. Channels 523 and 525 extend from these inlet ports through the length of the block 512, supplying carbonated water and non-carbonated water to the individual water valves 518. Syrup inlets 524 allow syrup to flow into channels in the block 512 and out through syrup outlets 526. There is one set of syrup inlets and outlets for each block 513 and valve 514.

Figure 29:
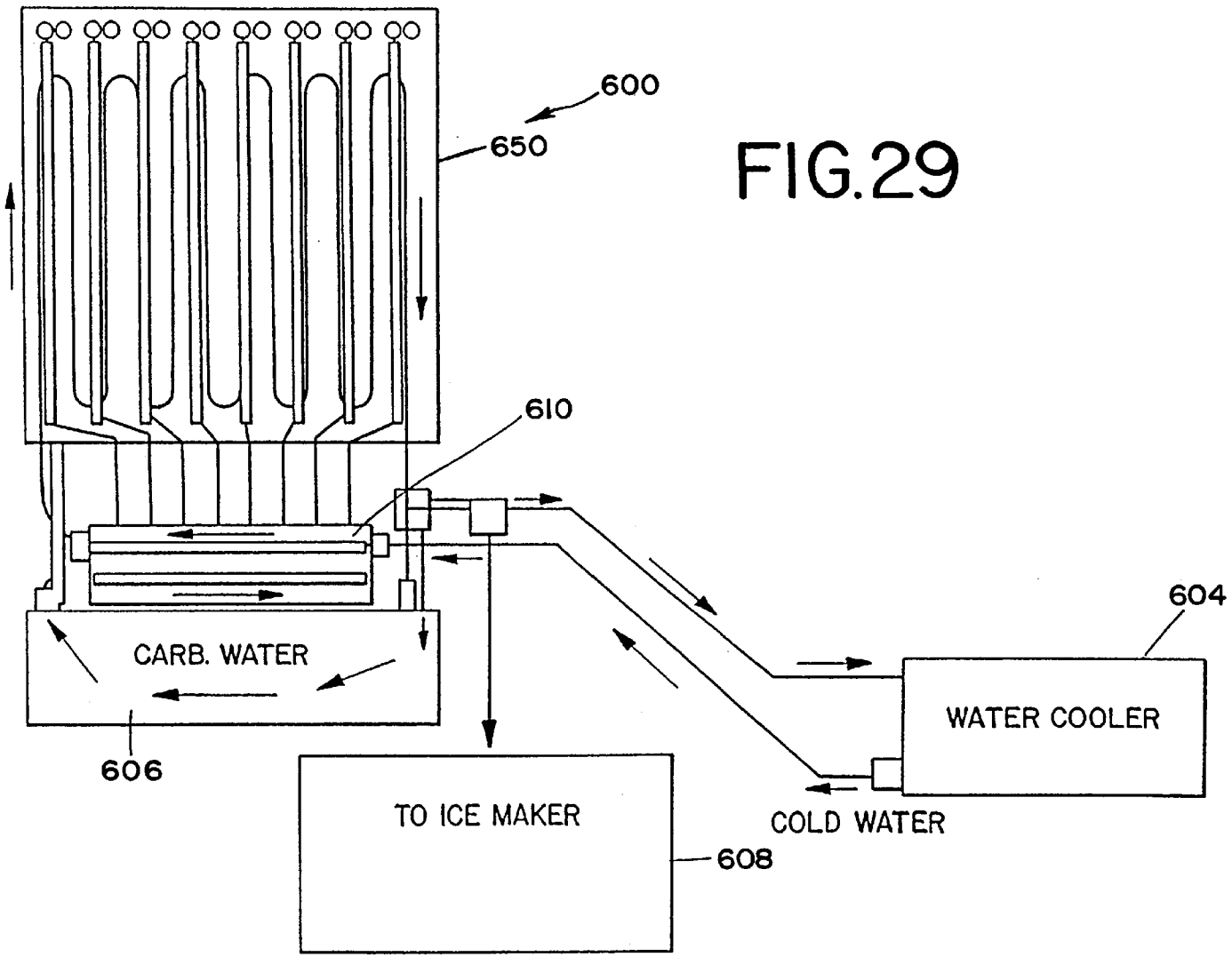
FIG. 29 is a schematic view of a seventh embodiment of a selection manifold in a beverage dispensing system.

A seventh embodiment of a selection manifold 610 is shown in FIG. 30, and used in the beverage dispensing system shown in FIG. 29. Carbonated water flows through channels 625 in block 612, while non-carbonated water flows through channels 623. Selector valves 618 can be rotated 180° so that water from one of the channels 623 and 625 flows through the inlet 636 in the selector valve and out the back of block 612, where it connects to lines going through cold plate 650 in the beverage dispensing system 600. Cold water from water cooler 604 supplies a water to a carbonator 606, and optionally an ice makes 608.

The present invention can be used with other types of beverage dispensing systems than the beverage and ice dispenser 1. Counter-electric and remote carbonation systems can also use the selection manifold of the present invention. In addition to switching between carbonated and non-carbonated water, the system could be designed to switch between two or more beverages such as sodas, beers and wines.

What is claimed is:

1. A beverage selection manifold for use with a beverage dispenser comprising:

a) a manifold block having first and second inlet fluid paths therethrough and at least five cells, each cell having first and second outlet openings therein;

b) a removable selector body associated with each cell, the removable selector body being switchable between i) a first position in which fluid entering the manifold block from the first inlet fluid path may pass through the first outlet opening and fluid from the second inlet fluid path is prevented from passing through the second outlet opening, and ii) a second position in which fluid entering the manifold block from the second inlet fluid path may pass through the second outlet opening and fluid from the first inlet fluid path is prevented from passing through the first outlet opening; and c) a retaining device to prevent unintentional change of the removable selector body between the first and second positions.

2. The beverage selection manifold of claim 1 wherein the removable selector body further comprises a portion that extends past an outer edge of the manifold body, such that the portion can be grasped by a user for positioning the removable selector body in the first position or the second position.

3. The beverage selection manifold of claim 1 wherein the fluid entering the manifold block from the first inlet fluid path comprises carbonated water, and wherein the fluid entering the manifold block from the second inlet fluid path comprises non-carbonated water.

4. The beverage selection manifold of claim 1 wherein the manifold block is integrated into a mounting block for the beverage dispenser.

5. The beverage selection manifold of claim 1 wherein the removable selector body comprises a single unitary device.

6. The beverage selection manifold of claim 1 wherein the removable selector body comprises a body having a fluid channel therethrough.

7. The beverage selection manifold of claim 1 wherein the first and second inlet fluid paths comprise independent channels in the manifold block, each channel having an opening at an end surface of the manifold block, and wherein the openings are adjacent to one another at the end surface.

8. The beverage selection manifold of claim 1 wherein the manifold block comprises a thermoplastic material.

9. A beverage dispenser comprising:

a) a beverage selection manifold;

b) a carbonated water line and a non-carbonated water line connected to the beverage selection manifold;

c) the beverage selection manifold including, i) a manifold block having first and second inlet fluid paths therethrough and at least five cells, each cell having first and second outlet openings therein, wherein the carbonated water line is connected to the first inlet fluid path and the non-carbonated water line is connected to the second inlet fluid path;

ii) a removable selector body associated with each cell, the removable selector body being switchable between A) a first position in which carbonated water entering the manifold block from the first inlet fluid path may pass through the first outlet opening and non-carbonated water from the second inlet fluid path is prevented from passing through the second outlet opening, and B) a second position in which non-carbonated water entering the manifold block from the second inlet fluid path may pass through the second outlet opening and carbonated water from the first inlet fluid path is prevented from passing through the first outlet opening; and iii) a retaining device to prevent unintentional change of the removable selector body between the first and second positions.

10. The beverage selection manifold of claim 9 wherein the removable selector body further comprises a portion that extends past an outer edge of the manifold block, such that the portion can be grasped by a user for positioning the removable selector body in the first position or the second position.

11. The beverage selection manifold of claim 9 wherein the removable selector body comprises a single unitary device.

12. The beverage selection manifold of claim 9 wherein the removable selector body comprises a body having a fluid channel therethrough.

13. The beverage selection manifold of claim 9 wherein the first and second inlet fluid paths comprise independent channels in the manifold block, each channel having an opening at an end surface of the manifold block, and wherein the openings are adjacent to one another at the end surface.

14. The beverage selection manifold of claim 9 wherein the manifold block comprises a thermoplastic material.

* * * * *

UNITED STATES PATENT AND TRADEMARK OFFICE

CERTIFICATE OF CORRECTION

PATENT NO. : 6,698,621 B2
DATED : March 2, 2004
INVENTOR(S) : Jerry L. Landers et al.

It is certified that error appears in the above-identified patent and that said Letters Patent is hereby corrected as shown below:

Title page,
Item [56], References Cited, U.S. PATENT DOCUMENTS, delete "Kierman" and substitute -- Kiernan -- in its place.
Item [57], ABSTRACT, delete "for use" (second occurrence).

Signed and Sealed this

First Day of March, 2005

JON W. DUDAS
*Director of the United States Patent and Trademark Office*